US007413492B2

(12) United States Patent
Meyer et al.

(10) Patent No.: US 7,413,492 B2
(45) Date of Patent: Aug. 19, 2008

(54) WATERCRAFT WITH ENGINE HOUSING

(75) Inventors: Michael Meyer, Suffolk, VA (US); Sidney L. Lanier, Bradenton, FL (US)

(73) Assignee: AB Volvo, Gothenburg (SE)

( * ) Notice: Subject to any disclaimer, the term of this patent is extended or adjusted under 35 U.S.C. 154(b) by 0 days.

(21) Appl. No.: 11/279,146

(22) Filed: Apr. 10, 2006

(65) Prior Publication Data

US 2007/0238372 A1 Oct. 11, 2007

(51) Int. Cl.
*B63H 20/32* (2006.01)

(52) U.S. Cl. ..... 440/76; 440/111

(58) Field of Classification Search ..... 440/76, 440/77, 78, 83, 111, 113; 114/382
See application file for complete search history.

(56) References Cited

U.S. PATENT DOCUMENTS

| | | | | | |
|---|---|---|---|---|---|
| 1,694,790 | A | * | 12/1928 | Nelson | 440/111 |
| 3,170,435 | A | * | 2/1965 | Najimian, Jr. | 440/111 |
| 3,223,067 | A | * | 12/1965 | Horan | 440/112 |
| 3,487,804 | A | * | 1/1970 | Kiekhaefer | 440/76 |
| 3,652,868 | A | * | 3/1972 | Hunt | 114/211 |
| 3,845,839 | A | * | 11/1974 | Eriksson | 440/77 |
| 4,678,439 | A | * | 7/1987 | Schlichthorst | 440/111 |
| 4,836,123 | A | | 6/1989 | Grinde et al. | |
| 4,925,414 | A | | 5/1990 | Newman | |
| 5,356,319 | A | * | 10/1994 | Parker | 440/76 |

* cited by examiner

*Primary Examiner*—Lars A Olson
(74) *Attorney, Agent, or Firm*—WRB-IP LLP

(57) ABSTRACT

A watercraft includes a hull, an engine, and a housing adapted to completely enclose the engine, the housing being adapted to be removably disposed in the hull.

21 Claims, 6 Drawing Sheets

WATERCRAFT WITH ENGINE HOUSING

BACKGROUND AND SUMMARY

The present invention relates to watercraft with engines and, more particularly, to watercraft having engine housings.

In boats it would be advantageous to mount the engine in the lowest part of the hull to allow for useful deck space above the engine. In this low hull area, however, the bilge water collects and presents an environment of humidity and water, which is corrosive and damaging to engines. It is necessary, therefore, to mount the engine above the bilge. In small boats there is often insufficient space to mount an engine both below the deck and above the bilge. As a result, the engine typically interferes with usable deck space.

If an engine is mounted on-board above the bilge in a boat, as for a stern drive system or inboard system, the engine and engine cover rise above the deck and take up valuable space at the stern. In boats, deck space is at a premium and this has led to the use of outboard engines as the propulsion system. Outboard engines, however, project above the transom of the boat and interfere with use of the stern area.

It is desirable to provide a watercraft with an engine arrangement that minimizes interference with deck and other space on the watercraft. It is also desirable to maintain an engine in an environment that is conducive to good operation of the engine.

According to an aspect of the present invention, a housing is provided that is adapted to completely enclose a watercraft engine. The housing is adapted to be removably disposed in a watercraft hull.

According to another aspect of the present invention, a watercraft is provided. The watercraft comprises a hull, an engine, and a housing adapted to completely enclose the engine, the housing being adapted to be removably disposed in the hull.

BRIEF DESCRIPTION OF THE DRAWINGS

The features and advantages of the present invention are well understood by reading the following detailed description in conjunction with the drawings in which like numerals indicate similar elements and in which.

DETAILED DESCRIPTION

Figure 1A:
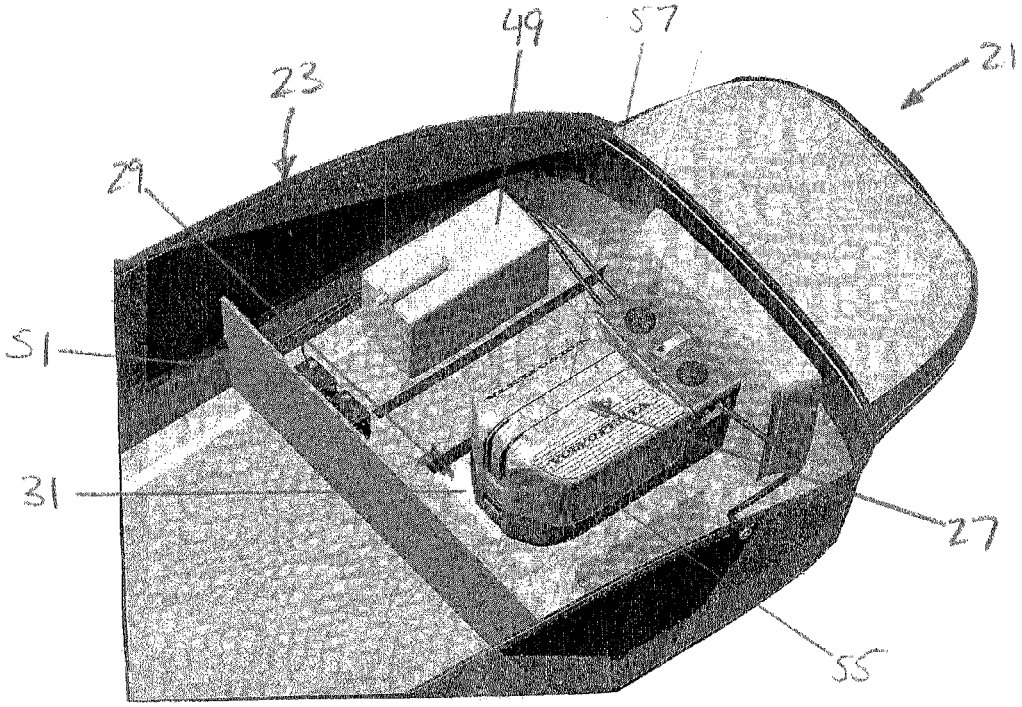
FIG. 1A is a top perspective view of a watercraft with an engine housing and FIG. 1B is a top perspective view of a portion of an engine housing and engine of the type shown in FIG. 1A.
Figure 1B:
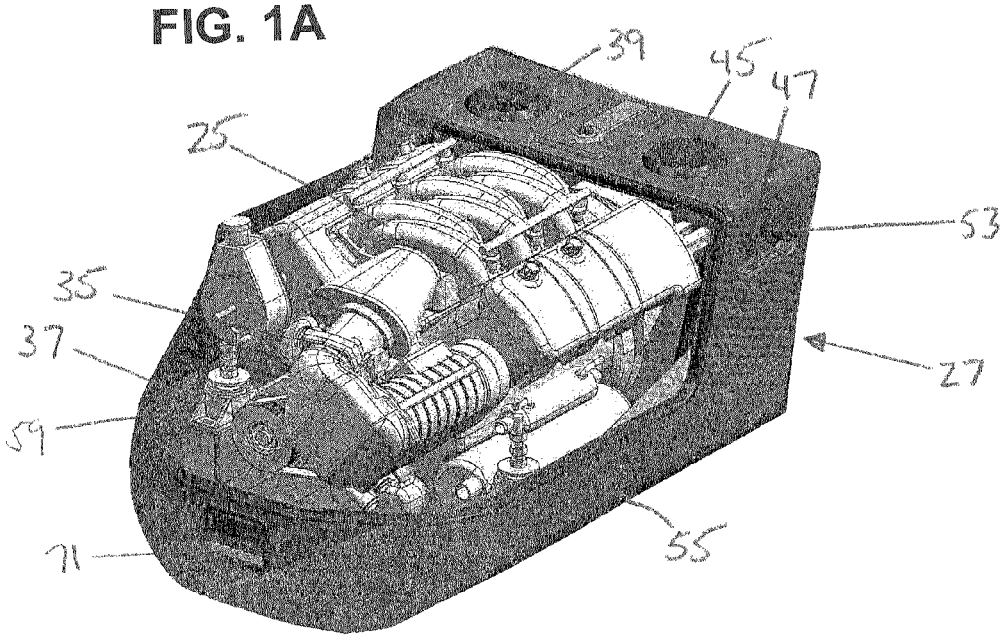

A watercraft 21 according to an embodiment of the present invention is shown in FIG. 1A. The watercraft 21 comprises a hull 23, an engine 25 (FIG. 1B), and a housing 27 adapted to completely enclose the engine. The housing 27 is adapted to be removably disposed in the hull 23. Ordinarily, the housing 27 will be disposed in the bottom 29 of the hull 23 and, more particularly, at least partially disposed in the bilge portion 31 of the bottom of the hull. In this way, the engine 25 and housing 27 can be located in positions that can minimize interference with usable deck area (and other areas) of the watercraft 21. This is particularly the case when the engine 25 is built so as to have a relatively low profile.

Figure 2:
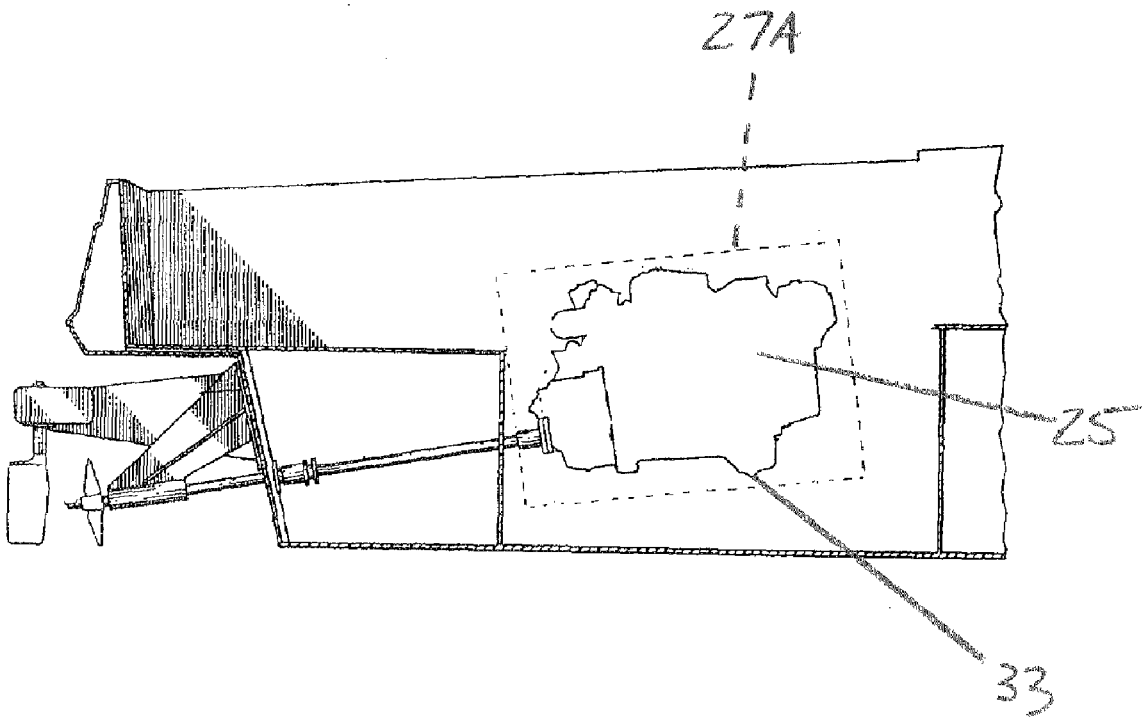
FIG. 2 is a schematic, partially cross-sectional view of a watercraft having an engine housing for an engine of an inboard drive system according to an embodiment of the present invention.
Figure 3A:
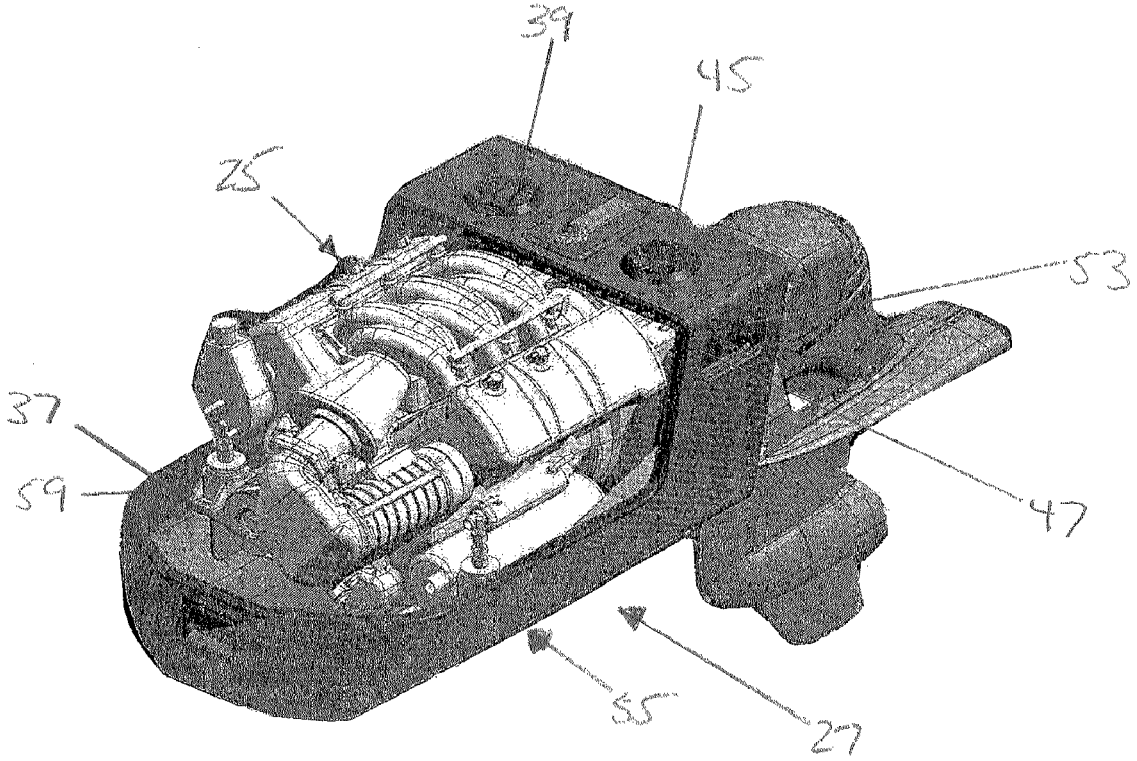
FIGS. 3A and 3B are top perspective views of a portion of an engine housing and an engine, and of an engine housing, respectively, for use with an inboard/outboard drive system according to an embodiment of the present invention.
Figure 3B:
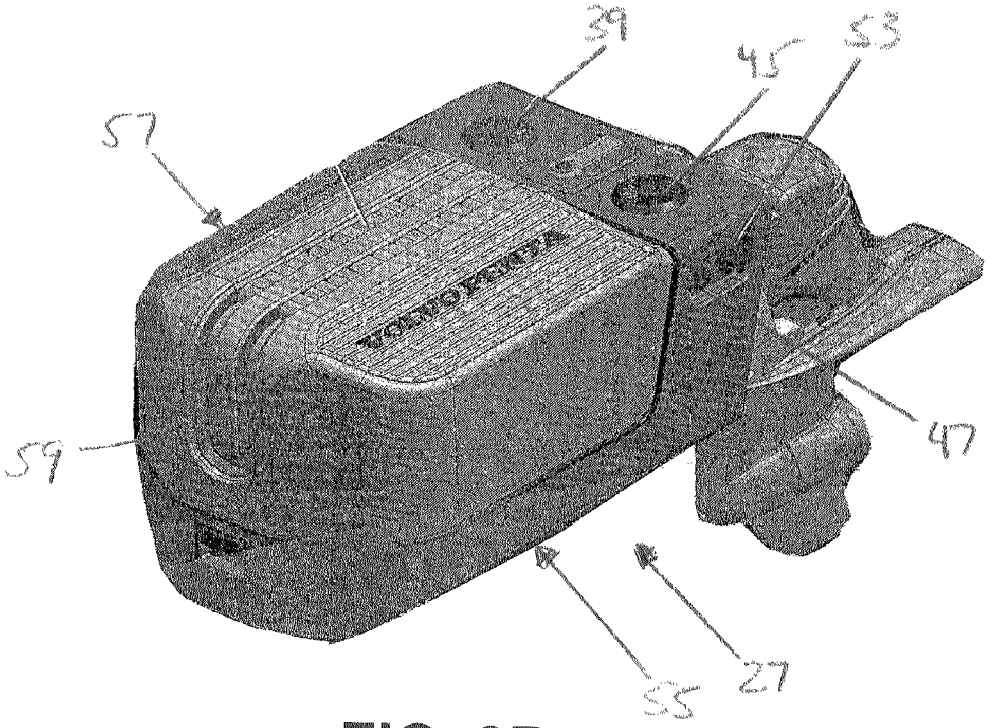

The housing 27 is not limited to use with any particular type of watercraft. As seen in FIG. 2, the housing 27A may enclose an engine 25A that comprises part of an inboard drive system for a watercraft. As seen in FIG. 3A, the housing 27 (shown as a two-piece housing without a cover 57 seen in FIG. 3B) may enclose an engine 25 that comprises part of an inboard/outboard drive system.

Figure 4:
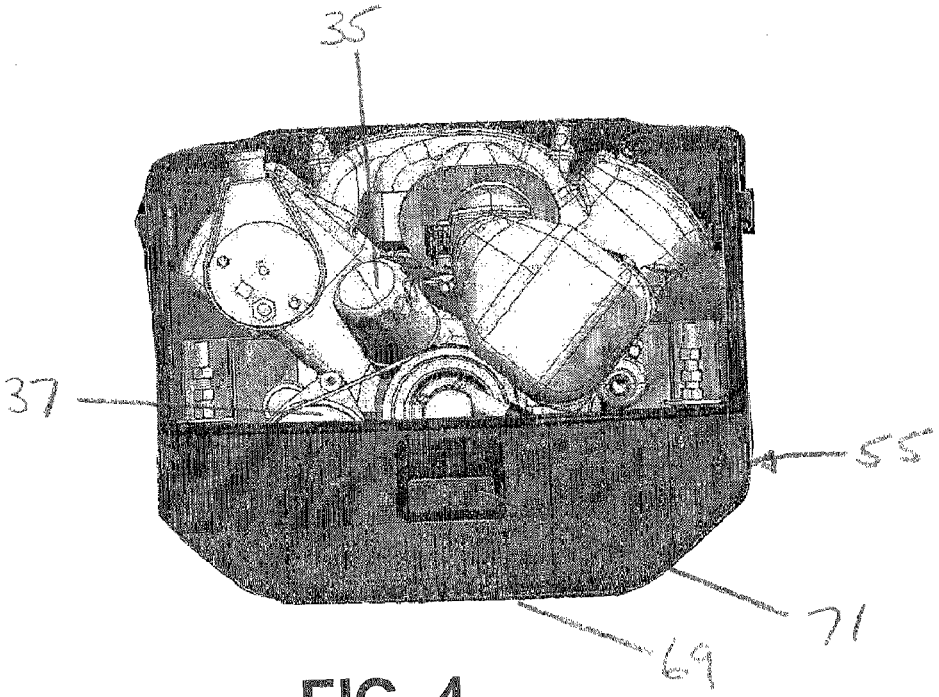
FIG. 4 is a front view of a portion of an engine housing and an engine according to an embodiment of the present invention.

The housing 27 will ordinarily be waterproof. All or substantially all of the engine service/maintenance items, such as an oil drain opening 33 (FIG. 2), an oil filter 35 as seen in FIG. 4, a water pump 37, a fuel filter and the like can be disposed inside of the housing 27. In this way, when performing service or maintenance on the engine 25, it is possible to minimize or eliminate contamination of bilge water with engine fluids and minimize pollution. In addition, locating engine service/maintenance items inside of the housing 27 facilitates keeping the area around the housing clean.

The housing 27 can also be arranged to provide soundproofing. While simply enclosing the engine 25 in the housing 27 will ordinarily provide some degree of soundproofing, the housing 27 can in addition be provided with additional soundproofing arrangements, such as noise-damping fabrics (not shown) on the inside and/or outside of the housing. The housing 27 can reduce or eliminate the need for soundproofing of an engine compartment, which can reduce costs and simplify manufacture of the watercraft.

Figure 5:
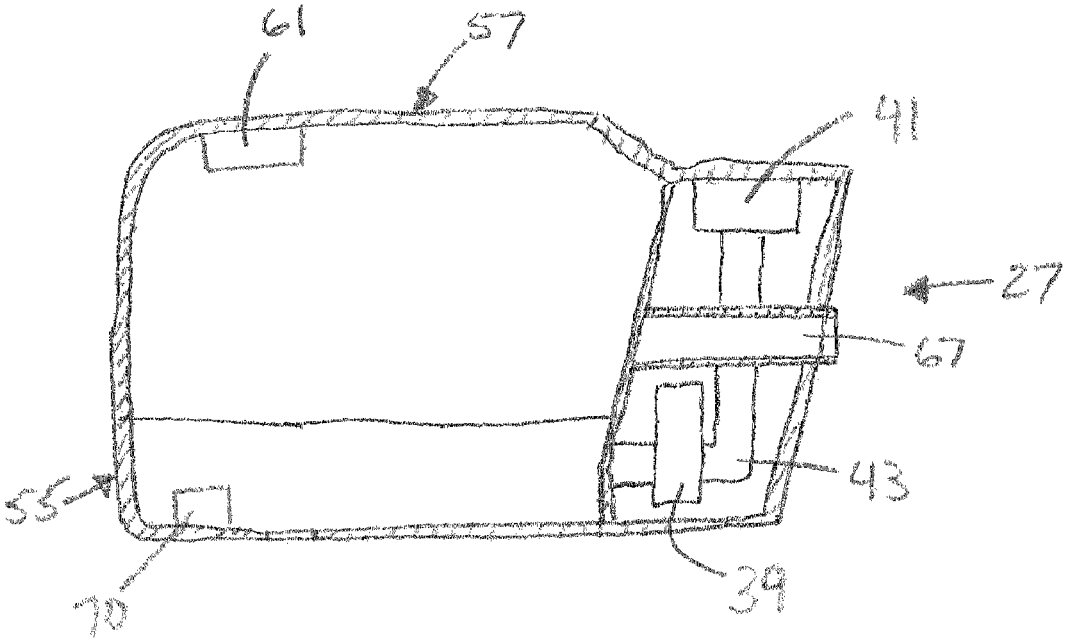
FIG. 5 is a side, cross-sectional, schematic view of an engine housing according to an embodiment of the present invention.

The housing 27 can also be air-tight, which can minimize the amount of corrosive, humid air that can attack the engine 25. Preferably, air will be drawn into the housing 27 by a blower 39 that can maintain the interior of the housing at a higher pressure than ambient or atmospheric pressure, thereby minimizing the possibility of air entering the housing except through the blower. Water and other harmful materials conveyed in inlet air can be removed by a suitable device such as a demister 41, as seen in FIG. 5 (other drawings show the blower 39 in the position of the demister to reflect that air can be drawn in (or blown out) at the illustrated location). The blower 39 can deliver air to the interior of the housing 27 in any suitable manner, such as through a conduit 43 in which a demister 41 is provided. The inlet of the blower 39 can be extended by a conduit to a place outside the engine compartment of the hull 23 where clean, relatively dry air is available, such as on the deck away from the exhaust area.

The same blower 39 and/or a separate blower 45 can be used to evacuate the interior of the housing 27. For example, it may be desirable to evacuate fumes from the housing 27 prior to opening the housing and exposing the interior of the housing it to flame or spark sources outside of the housing.

The blower 39 or blowers 39 and 45 can also be used to pull cooling air into the housing 27 when the engine 25 is hot, but not running, as for example, on shutting down. The cooling air exhaust can be ducted outside the engine compartment, keeping heat transfer to the engine compartment to a minimum.

Exhaust from the engine 25 will ordinarily be vented through a drive shaft opening 67 or through a separate opening (not shown) and may be treated to remove pollutants outside of the housing. The exhaust will also often pass through a muffler (not shown) outside of the housing. If desired, devices such as exhaust aftertreatment and mufflers can be provided inside of the housing. As seen for example in FIGS. 3A-3B and 6-7B, a fuel inlet 47 can facilitate connection of the engine 25 to a fuel source 49 (FIG. 1A) remote from the engine. Electrical connections to the engine 25, such as to a battery 51 (FIG. 1A) can be made through one or more electrical connection points 53.

Generally speaking, the housing 27 can provide an environment for the engine 25 that is substantially more conducive to proper operation of the engine than if the engine were exposed to the environment in the hull of the watercraft. In addition, the housing 27 can protect the environment outside of the housing from certain engine wastes and discharges. All maintenance and service of the engine 25 can be performed inside of the housing 27, thereby reducing the possibility of spillages and the like.

In addition, the housing 27 can be adapted to isolate an environment surrounding the engine 25 from an environment outside the housing such that fumes inside the housing cannot be ignited by sources outside the housing. In this way, it can be easier to satisfy ignition protection requirements such as are set out in 33 CFR 183.401-183.460 and costs can be reduced.

The housing 27 will ordinarily be removably mounted relative to the watercraft hull 23. The specific mountings for the housing 27 can be of any suitable type, however, it is desirable that the mountings facilitate avoidance of unintentional entry or exit of fluids or fumes into and from the housing. While the housing 27 might be mounted by means such as bolts extending through gasketed openings in the housing, it may be preferable to avoid openings in the housing through which liquids or fumes might pass and provide flanges (not shown) on the housing. The flanges can include openings through which bolts can extend to mount the housing 27 to the hull 23. If it is desired to service, maintain, or replace the engine 25, by removably mounting the housing 27 to the watercraft hull 23, the engine 25 can be removed together with the housing 27. Conventional connections of shafts, hoses, wires, and the like to the engine 25 can be adapted for relatively simple disconnection to facilitate removal of the housing 27 together with the engine 25 from the watercraft 21. In this way, installation and removal of the housing 27 together with the engine 25 in and from the watercraft is facilitated.

The housing 27 will ordinarily include a base portion 55, as seen in FIGS. 1B, 3A-8, and a cover portion 57, as seen in FIGS. 3B, 5, 7A-8, attachable to the base portion to enclose the engine 25. A gasket 59 will ordinarily be provided to seal the joint between the base portion 55 and the cover portion 57 to preventingress and egress of air, fumes, water, etc. For example, air will ordinarily only enter and exit the housing 27 through at least one air passage defined by the blower 39, the conduit 43 and, if provided, the second blower 45.

A fireproofing system 61 (shown schematically in FIG. 5) can be provided in the housing 27. The fireproofing system 61 can be any suitable type of fireproofing system, such as a HALON system. Because of the smaller volume of the housing 27 relative to a typical engine room or compartment, the fireproofing system can be appropriately sized for effectiveness and economy. The housing 27 can be made of fire retardant material, which protects the boat and occupants in the event of an engine fire.

Figure 6:
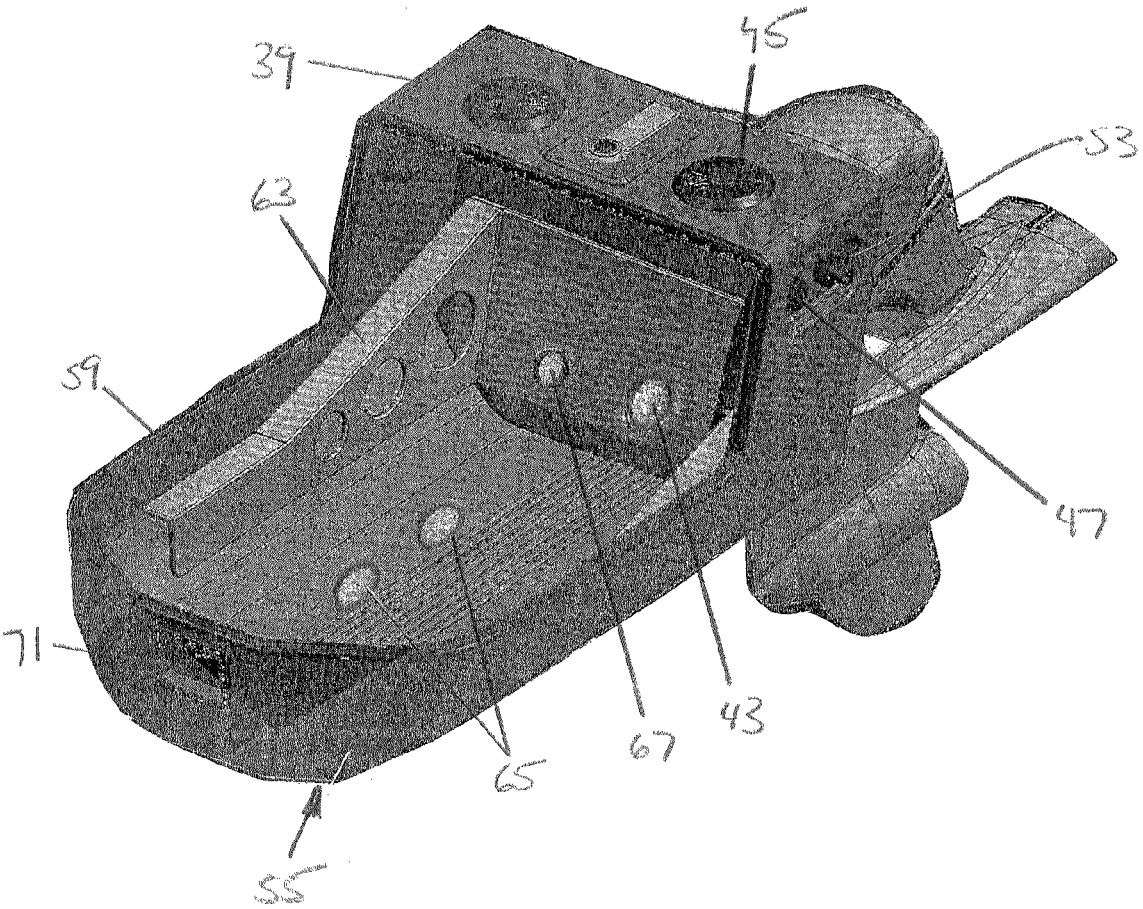
FIG. 6 is a top perspective view of a portion of an engine housing according to an embodiment of the present invention.

As seen in FIG. 6, an interior of the housing 27 can be provided with an engine mount 63. If an engine mount 63 is provided, its configuration will ordinarily be dictated by the configuration of the engine 25. The engine 25 can, of course, be mounted directly to the housing 27, such as by bolts (not shown) extending through walls of the housing, without the need for providing a separate engine mount. Providing an engine mount 63 facilitates isolating the interior of the housing 27 from the outside as the engine mount avoids any need to extend bolts through walls of the housing. Also, the engine mount 63 facilitates engine 25 alignment by providing an aligned framework within the housing 27.

A drive shaft (not shown) of the engine 25 can pass through an opening 67 provided in the housing. The rear 68 of the housing 27 can be shaped to conform to the shape of a transom (not shown) or other structure against which it is desired to position the housing.

Figure 8:
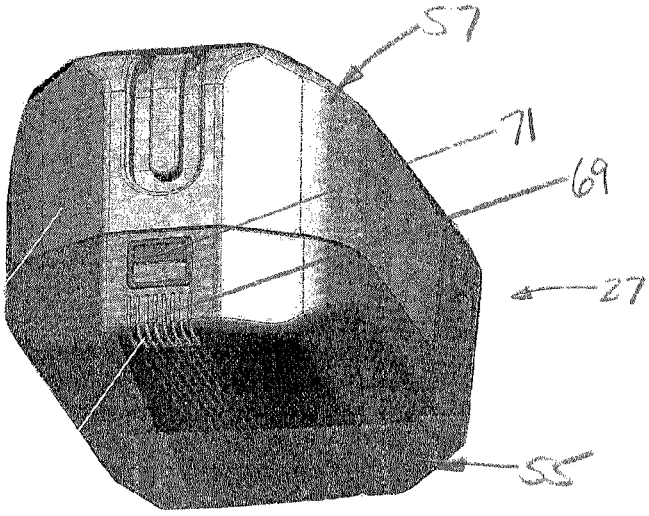
FIG. 8 is a bottom perspective view of an engine housing according to an embodiment of the present invention.
Figure 7A:
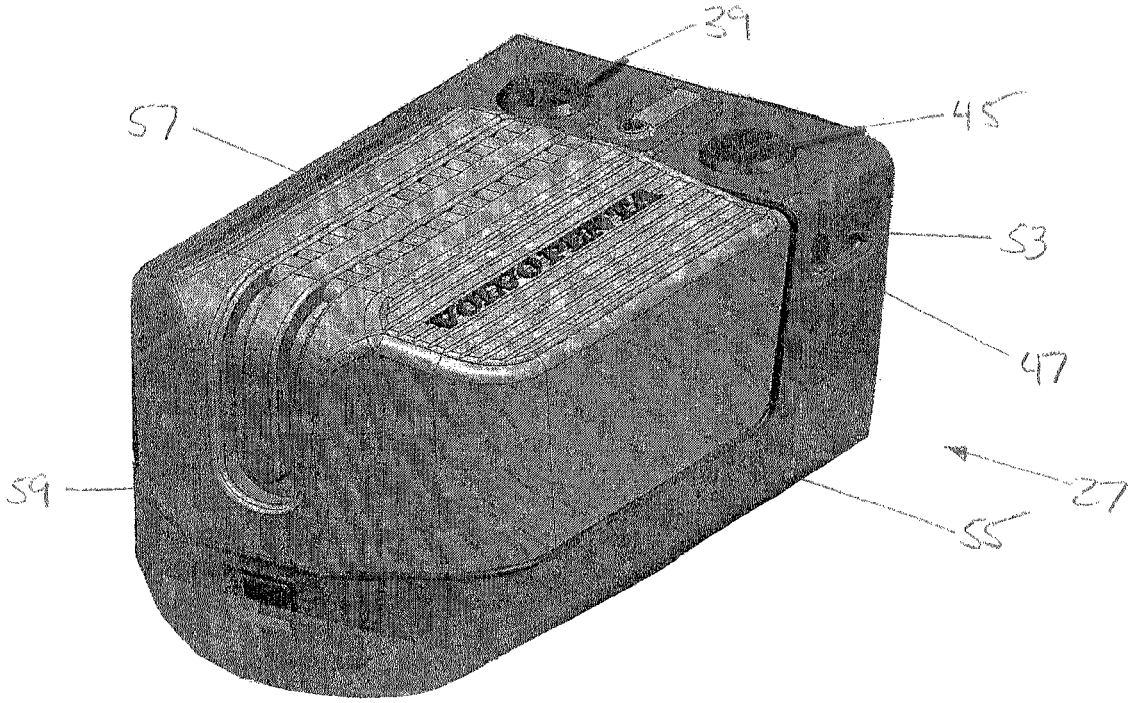
FIG. 7A is a top perspective view and FIG. 7B is a side view of an engine housing according to an embodiment of the present invention.
Figure 7B:
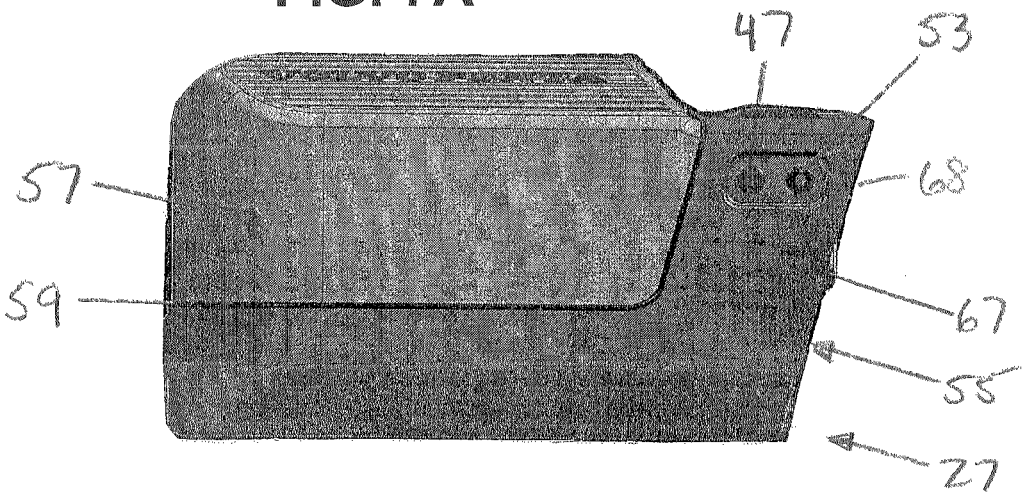

A light-based water level sensor (not shown) may be provided in the housing 27. A light beam can pass through a window 69 as seen in FIG. 8. The window 69 can be provided in any location in the housing, ordinarily at a location such that, should water rise to a certain level relative to the window, a photosensitive sensor will detect a change in the light beam and send a signal to a controller (not shown) which will activate a bilge pump 70 (shown schematically in FIG. 5) or sound an alarm (not shown) in response to the signal. The bilge pump 70 can be located in the housing 27, with suction tubes or inlets (not shown) extending into the bilge area 31 (FIG. 1A). This can protect the bilge pump motor from being submerged, which prevents corrosion and extends its life.

The cover 57 and the base 55 can be held together in any suitable manner. Typically, a latch 71 is provided to secure the cover 57 relative to the base 55.

In the present application, the use of terms such as "including" is open-ended and is intended to have the same meaning as terms such as "comprising" and not preclude the presence of other structure, material, or acts. Similarly, though the use of terms such as "can" or "may" is intended to be open-ended and to reflect that structure, material, or acts are not necessary, the failure to use such terms is not intended to reflect that structure, material, or acts are essential. To the extent that structure, material, or acts are presently considered to be essential, they are identified as such.

While this invention has been illustrated and described in accordance with a preferred embodiment, it is recognized that variations and changes may be made therein without departing from the invention as set forth in the claims.

What is claimed is:

1. A housing adapted to completely enclose a watercraft engine, the housing being adapted to be removably disposed in a watercraft hull, comprising a blower associated with the at least one air passage, the blower being adapted to maintain an interior volume of the housing at a pressure above atmospheric pressure.

2. The housing as set forth in claim 1, wherein the housing is waterproof.

3. The housing as set forth in claim 1, comprising a demister for removing moisture from air at the at least one air passage.

4. The housing as set forth in claim 1, wherein the blower is adapted to evacuate an interior volume of the housing such that a pressure of the interior volume is lower than atmospheric pressure.

5. The housing as set forth in claim 1, comprising a fireproofing system in the housing.

6. The housing as set forth in claim 1, wherein the housing provides sound insulation.

7. The housing as set forth in claim 1, wherein the housing is adapted to isolate an environment surrounding the engine from an environment outside the housing such that fumes inside the housing cannot be ignited by sources outside the housing.

8. The housing as set forth in claim 1, wherein an interior of the housing has an engine mount.

9. The housing as set forth in claim 1, wherein the housing comprises a base portion having an opening and a cover removably attached over the opening.

10. The housing as set forth in claim 1, comprising at least one opening in the housing through which cooling water for the engine is adapted to flow.

11. The housing as set forth in claim 1, wherein the housing is adapted to be removably disposed in a bottom of the watercraft hull.

12. The housing as set forth in claim 1, wherein the housing is adapted to be removably disposed in a bilge area of the watercraft hull.

13. A watercraft, comprising:

a hull;

an engine;

a housing adapted to completely enclose the engine, the housing being adapted to be removably disposed in the hull, the housing comprising at least one air passage in flow communication with an interior of the housing surrounding the engine, wherein air is adapted to enter and exit the housing only through the at least one air passage; and a blower associated with the at least one air passage, the blower being adapted to maintain an interior volume of the housing at a pressure above atmospheric pressure.

14. The watercraft as set forth in claim 13, wherein the engine comprises part of an inboard drive system.

15. The watercraft as set forth in claim 13, wherein the engine comprises part of an inboard/outboard drive system.

16. The watercraft as set forth in claim 13, wherein the housing is adapted to be removably disposed in a bottom of the watercraft hull.

17. The watercraft as set forth in claim 13, wherein the housing is adapted to be removably disposed in a bilge area of the watercraft hull.

18. The watercraft as set forth in claim 13, wherein the engine comprises an oil drain, the oil drain being disposed inside of the housing.

19. The watercraft as set forth in claim 13, wherein the engine comprises a water pump, the water pump being disposed inside of the housing.

20. The watercraft as set forth in claim 13, wherein the engine comprises an oil filter, the oil filter being disposed inside of the housing.

21. A watercraft, as set forth in claim 13, comprising a bilge pump disposed inside of the housing.

* * * * *